United States Patent [19]

Ishikawa et al.

[11] Patent Number: 4,636,759

[45] Date of Patent: Jan. 13, 1987

[54] ELECTRICAL TRAP CONSTRUCTION

[75] Inventors: Youhei Ishikawa, Kyoto; Tadahiro Yorita, Kanazawa; Sadao Yamashita, Kyoto, all of Japan

[73] Assignee: Murata Manufacturing Co., Ltd., Japan

[21] Appl. No.: 714,380

[22] Filed: Mar. 21, 1985

[30] Foreign Application Priority Data

| | | | |
|---|---|---|---|
| Mar. 30, 1984 | [JP] | Japan | 59-47254[U] |
| Apr. 13, 1984 | [JP] | Japan | 59-55160[U] |
| Aug. 9, 1984 | [JP] | Japan | 59-122461[U] |

[51] Int. Cl.[4] ..... H01P 7/04; H01P 1/202; H01P 5/00

[52] U.S. Cl. ..... 333/223; 333/206; 333/207; 333/260

[58] Field of Search ..... 333/202, 206, 207, 223, 333/222, 181–185, 12, 260; 339/147 R, 126 J, 130 R, 130 C, 143 R, 143 C

[56] References Cited

U.S. PATENT DOCUMENTS

| | | | |
|---|---|---|---|
| 2,392,664 | 1/1946 | Gurewitsch | 333/207 |
| 2,470,805 | 5/1949 | Collard | 333/206 |
| 4,434,410 | 2/1984 | Miyake et al. | 333/207 X |

*Primary Examiner*—Marvin L. Nussbaum

*Attorney, Agent, or Firm*—Ostrolenk, Faber, Gerb & Soffen

[57] ABSTRACT

An improved electrical trap construction for use in a high frequency circuit device, which is so arranged that a coaxial resonator is connected to a core pin of a coaxial connector mounted on a case which contains the device, so that main currents received from a hot signal line flow into or flow out of the coaxial resonator the inner conductive electrode layer of the coaxial resonator is in electrically conducting contact with the core pin of the connector so as to allow the coaxial resonator to provide parallel resonance at a frequency to be trapped.

16 Claims, 11 Drawing Figures

ELECTRICAL TRAP CONSTRUCTION

BACKGROUND OF THE INVENTION

The present invention generally relates to a high frequency circuit arrangement, and more particularly, to an electrical trap construction comprising a coaxial cable or coaxial resonator for use in a high frequency circuit device of compact size.

Conventionally, for a band-pass filter employing a plurality of dielectric coaxial resonators, there has been proposed an arrangement, for example, as shown in FIG. 1, which generally includes a casing H having an input side connector Ic and an output side connector Oc, a plurality of dielectric coaxial resonators R each including a cylindrical ceramic dielectric member, inner and outer conductive electrode layers respectively formed on corresponding inner and outer peripheral surfaces of the cylindrical ceramic dielectric member and another electrode layer formed on one end face of said dielectric member so as to shortcircuit the inner and outer conductive electrode layer to each other for resonance at a $\frac{1}{4}$ wavelength, and coupling capacitors C for coupling the respective coaxial resonators R.

The coupling capacitors C are inserted in series in a hot signal line L between the input connector Ic and the output connector Oc, while terminals (not shown) fixed to the inner conductive electrodes of the respective resonators R are connected between said coupling capacitors C, with the outer conductive electrodes thereof being grounded, thus constituting a band-pass filter F. The arrangement of FIG. 1 further includes an electrical trap T for suppression of spurious signals. The trap T is constituted by a dielectric coaxial resonator Rt having the construction similar to that of the resonators R, a capacitor Ct connected, at its one end, to an inner conductive electrode layer of the resonator Rt and, at its other end, between the neighboring coupling capacitor C and the output connector Oc, with an outer conductive electrode layer of said resonator Rt being grounded, thereby to produce a series resonance at the spurious frequency to be suppressed, by an inductance presented by the resonator Rt and the capacitor Ct.

The trap construction as described above with reference to FIG. 1, however, has the drawback that the separate space required for accommodation of the coaxial resonator Rt and capacitor Ct within the casing H limits the degree to which the size of a device incorporating the trap can be reduced.

SUMMARY OF THE INVENTION

Accordingly, an essential object of the present invention is to provide an improved electrical trap construction which is capable of reducing the size of a device incorporating such trap construction.

Another object of the present invention is to provide an electrical trap construction of the above described type in which a core wire and an outer conductor of a coaxial cable are connected to a core pin of a coaxial connector of a high frequency circuit device so as to cause the coaxial cable to function as a trap for suppressing spurious signals, thus achieving compact size and reduction in cost.

A further object of the present invention is to provide an electrical trap construction of the above described type which employs a coaxial resonator adapted to cause parallel resonance at a frequency to be trapped.

In accomplishing these and other objects, according to one embodiment of the present invention, there is provided an electrical trap construction which includes an input/output coaxial connector having a core pin and provided on a case for a high frequency circuit device; and a coaxial cable including an outer conductor, a core wire, and a dielectric member provided between the outer conductor and the core wire. The coaxial cable is connected, at the core wire and the outer conductor thereof, with the core pin of the coaxial connector, and accommodated within a through-bore formed in the case in position at the back of the coaxial connector, with the outer conductor of the coaxial cable being insulated from the case.

According to another embodiment of the present invention, there is also provided an electrical trap construction employing a coaxial resonator, which includes an input/output connector having a core pin and provided on a case for a high frequency circuit device, and a coaxial resonator including a dielectric member, inner and outer conductive electrode layers formed on corresponding inner and outer peripheral surfaces of the dielectric member and a short-circuiting electrode layer provided at one end of said dielectric member for conduction between the inner and outer conductive electrode layer. The coaxial resonator is fitted onto the core pin of the connector so that main currents flow into or flow out of the coaxial resonator to or from a hot signal line, with the inner conductive electrode layer of the coaxial resonator being in electrically conducting contact with the core pin of the connector and with the outer conductor of the coaxial resonator being insulated from the case, thereby to allow the coaxial resonator to cause parallel resonance at a frequency to be trapped.

By the arrangement according to embodiments of the present invention as described above, an improved electrical trap construction has been advantageously presented.

BRIEF DESCRIPTION OF THE DRAWINGS

These and other objects and features of the present invention will become apparent from the following description of preferred embodiments thereof with reference to the accompanying drawings, in which.

DETAILED DESCRIPTION OF PREFERRED EMBODIMENTS

Figure 1:
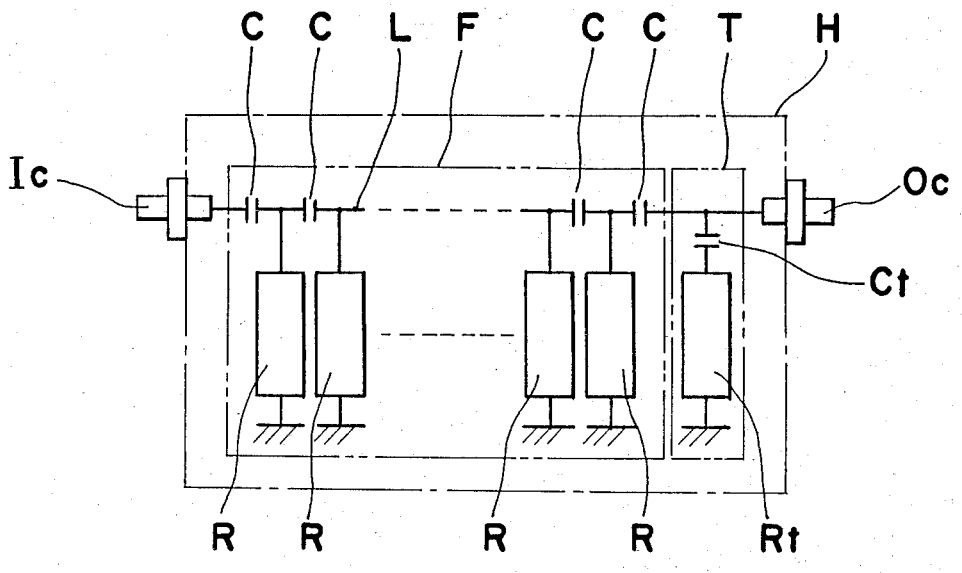
Fig. 1 PRIOR ART
FIG. 1 is a schematic diagram showing the construction of a conventional band-pass filter employing a plurality of dielectric coaxial resonators.

Before the description of the present invention proceeds, it is to be noted that like parts are designated by like reference numerals throughout the accompanying drawings.

Figure 2:
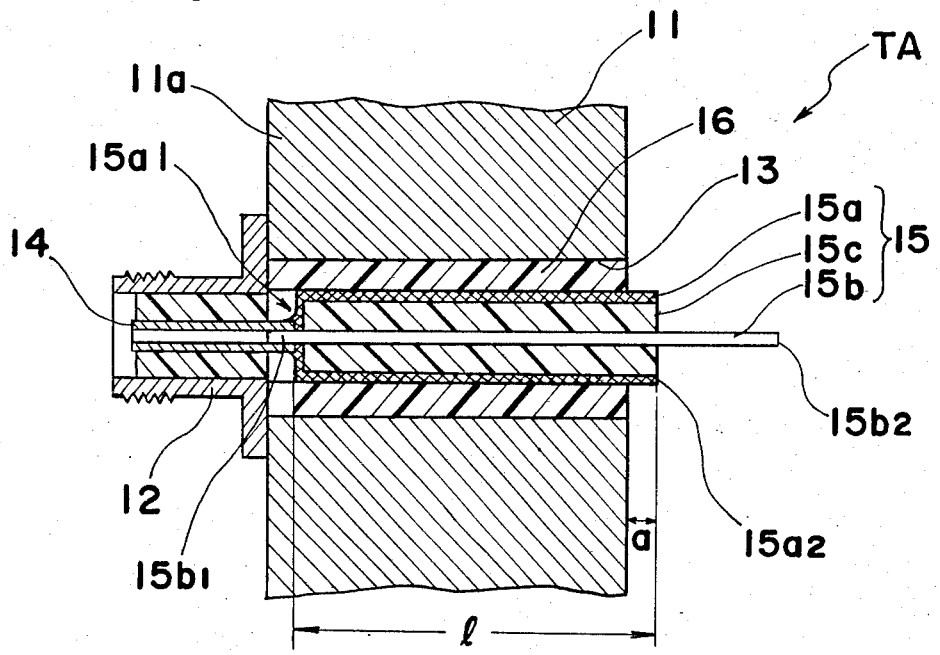
FIG. 2 is a sectional view of an electrical trap construction according to one embodiment of the present invention.

Referring now to the drawings, there is shown in FIG. 2, an electrical trap construction TA according to one embodiment of the present invention, which includes an input/output coaxial cable connector 12 having a core pin 14, which is mounted on a side wall 11*a* of a metallic case 11 of a high frequency circuit device for input into or output from the high frequency circuit device. A through-bore 13 is formed in the side wall 11*a* adjacent said coaxial connector 12. The bore 13 receives a coaxial cable 15 of a semi-rigid type having an outer conductor 15*a*, a core wire 15*b*, and a dielectric member 15*c* provided between said outer conductor 15*a* and said core wire 15*b*. The cable 15 has a length l which is $\frac{1}{4}$ of a signal wavelength λ to be eliminated (that is, $l=\lambda/4$). The cable 15 is inserted into the through-bore 13, and an insulative member 16 is fitted onto the outer conductor 15 within said through-bore 13, thereby to electrically insulate said outer conductor 15*a* of the coaxial cable 15 from said side wall 11*a* of the metallic case 11. One end 15*a*1 of the outer conductor 15*a* of said coaxial cable 15 and also one end 15*b*1 of said core wire 15*b* being soldered to the core pin 14 of the coaxial connector 12, the other end 15*b*2 of the core wire 15*b* of said coaxial cable 15 being connected to a further input or output terminal (not shown) of said high frequency circuit device.

Figure 3:
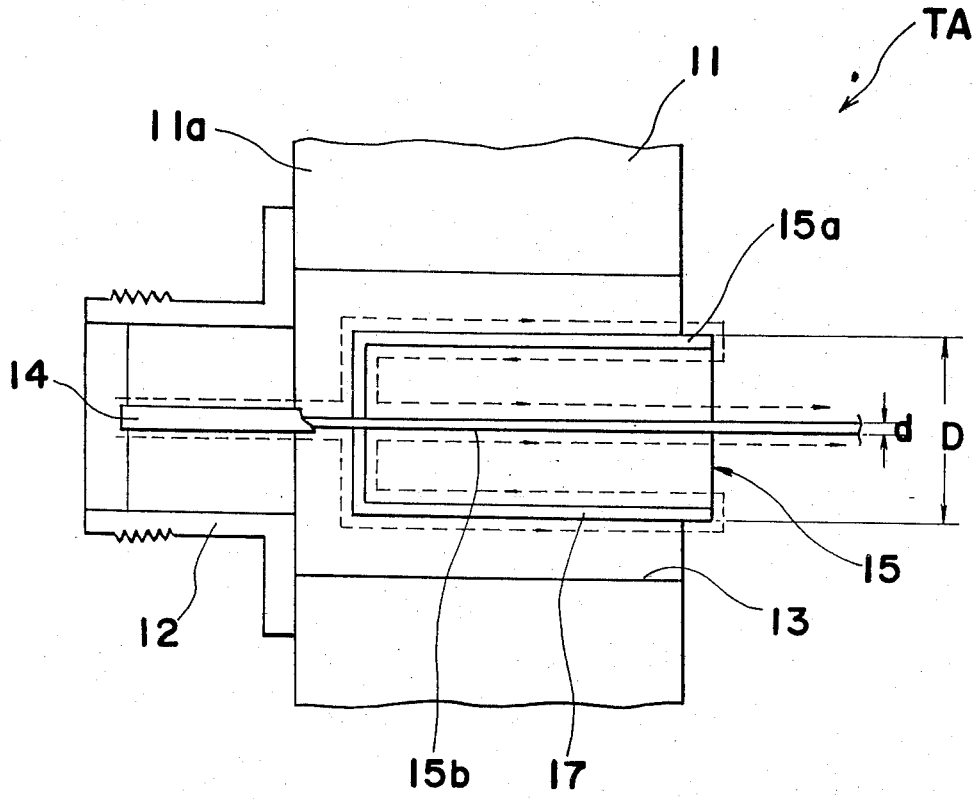
FIG. 3 is a diagram explanatory of main current passages of the trap construction in FIG. 2.

By the above arrangement, the coaxial cable 15 constitutes a dielectric coaxial resonator having one end 15*a*1 of the outer conductor 15*a* as a short-circuited end, and the other end 15*a*2 thereof as an open end, and main currents flow therethrough as shown by the dotted lines in FIG. 3.

Figure 6:
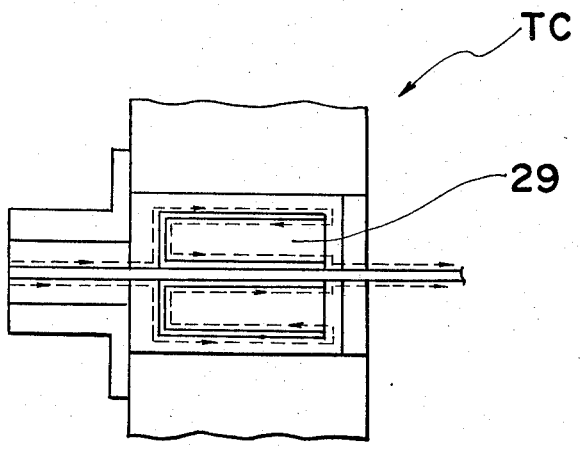
FIG. 6 is a diagram explanatory of main current passages of the trap construction in FIG. 5.
Figure 9:
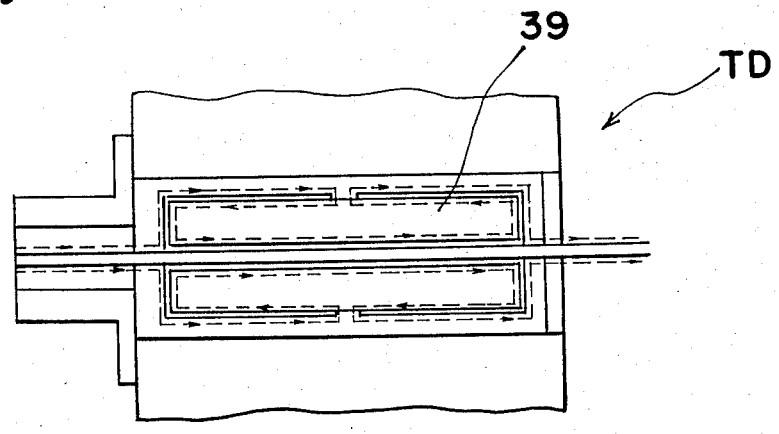
FIG. 9 is a diagram explanatory of main current passages of the trap construction in FIG. 8.

More specifically, in FIG. 3, on the assumption that the main currents flow in the direction indicated by arrows in a positive half cycle, such main currents flow in a direction opposite to that as indicated by the arrows in a negative half cycle. It is to be noted here that flow states of the main currents that are similar to the flow state of FIG. 3 are seen in FIGS. 6 and 9 to be described later.

Figure 4:
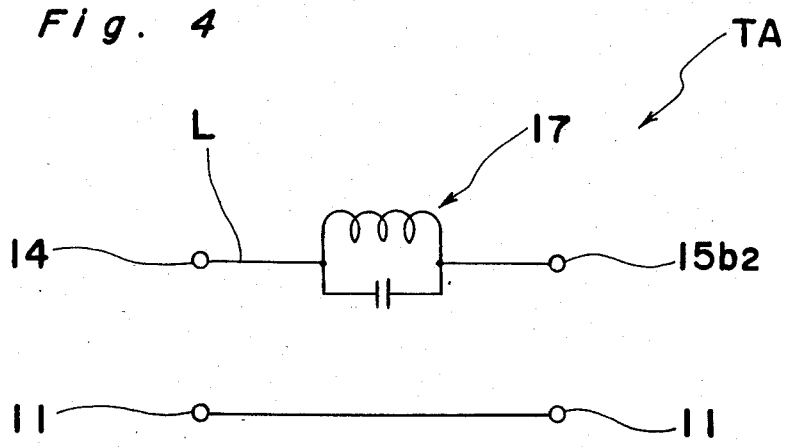
FIG. 4 is an equivalent circuit diagram of the trap construction of FIG. 2.

FIG. 4 shows an equivalent circuit of the dielectric coaxial resonator constituted as described above. A parallel resonance circuit 17 based on the dielectric coaxial resonator constituted by the coaxial cable 15 is inserted into a hot line L, and the spurious signals are trapped by said parallel resonance circuit 17.

The trap as described above will be explained more specifically hereinbelow.

The frequency ft to be trapped is determined by a dielectric constant $\epsilon\gamma$ of the dielectric member 15*c* for the coaxial cable 15 and the length l (axial length) of said dielectric member 15*c*, and represented by the equation, $$f_t = \frac{c}{4l\sqrt{\epsilon r}} \tag{1}$$

where c is the velocity of light.

Meanwhile, the amount of attenuation of the above trap may be calculated as follows.

Now, on the assumption that the characteristic impedance of the above parallel resonance circuit is represented by Za, the relation will be $$Za = \frac{60}{\sqrt{\epsilon r}} \log \frac{D}{d} \tag{2}$$

where D is the outer diameter of the outer conductor 15*a* of the coaxial cable 15, and d is the diameter of the core wire 15*b*.

The impedance Z of the above parallel resonance circuit 17 may be represented by $$Z = Za \tan \frac{\omega \sqrt{\epsilon r}\, l}{c} \tag{3}$$

Since this impedance is inserted in series in the high frequency circuit with a characteristic impedance Zo, the attenuation amount Att will be represented by an equation.

$$Att = 20 \log \left| \frac{2}{2 + Za/Zo \tan \frac{\omega \sqrt{\epsilon r}\, l}{c}} \right| \text{(dB)} \tag{4}$$

By way of example, in a case where D=5 mm, d=2 mm and $\epsilon\gamma=21$, and a third-harmonic band-pass filter for a fundamental center frequency fo=800 MHz is to be trapped to exclude spurious signals 10 MHz above and below the third harmonic, the relations will be Att=25.7 dB at 2390 MHz and Att=24.8 dB at 2410 MHz, thus making it possible to suppress spurious signals over 24 dB. Meanwhile, the characteristic impedance Za presented by the above parallel resonance circuit 17 in the passing band region becomes 6.9 ohms, with a reflection factor of 0.065 with respect to the characteristic impedance Zo=50 ohms, i.e., 23.8 dB in a reflection attenuation amount, thus hardly affecting the reflection factor of the high frequency circuit device.

It should be noted here that, in the foregoing embodiment, the dielectric member 15*c* and the outer conductor 15*a* of the coaxial cable 15 are adapted to project from the side wall 11 in the position remote from the coaxial connector 12 to a certain extent as shown in FIG. 2, and through alteration of the amount of protrusion or by scraping off part of the protrusion, the trapping frequency may be readily adjusted.

Figure 5:
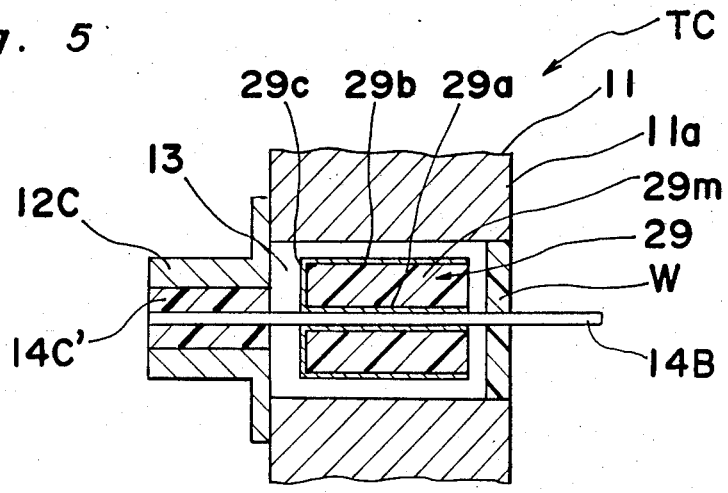
FIG. 5 is a sectional view of an electrical trap construction according to a second embodiment of the present invention.
Figure 7:
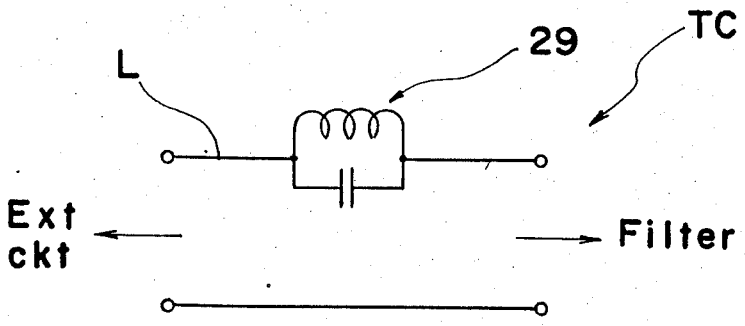
FIG. 7 is an equivalent circuit diagram of the trap construction of FIG. 5.

In a trap construction TC according to a second embodiment of the present invention as shown in FIGS. 5 through 7, there is employed a coaxial resonator 29 having inner and outer conductive electrode layers 29*a* and 29*b* and a short-circuiting layer 29*c* formed on a dielectric member 29*m*, and a short insulative member 14C' provided only within the connector 12C, so that the inner conductive electrode layer 29*a* is held in contact and, consequently, in conduction with the core pin 14B of the connector 12C, while the outer conductive electrode layer 29*b* is spaced from the wall 11*a* of the case 11 so as to be out of conduction therewith, with a bushing W for fixing the core pin 14B being provided at the end portion of the through-bore 13 remote from the connector 12C.

In the trap construction TC as described above, main currents flow in the manner as shown by dotted lines in FIG. 6, while an equivalent circuit is represented as shown in FIG. 7, in which the parallel resonance circuit provided by the coaxial resonator 29 is inserted in the hot line L, thereby to trap spurious signals.

Figure 8:
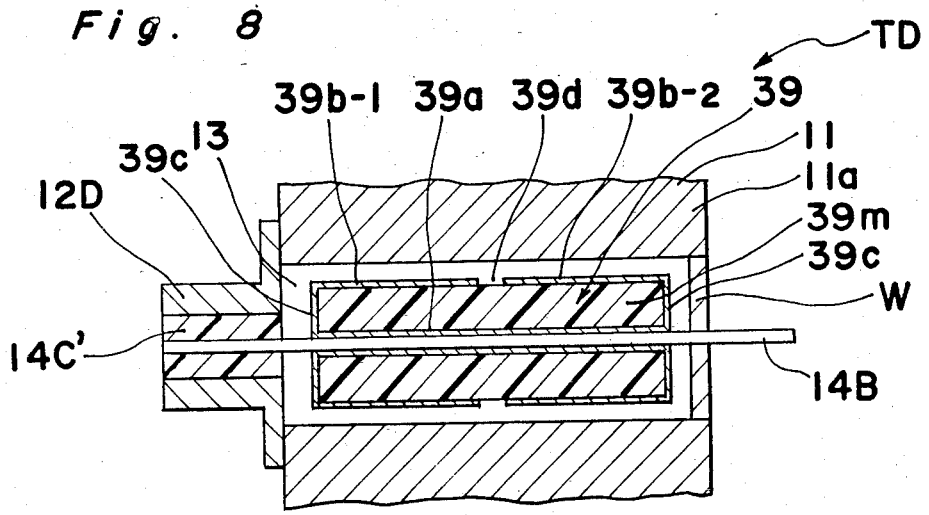
FIG. 8 is a sectional view of an electrical trap construction according to a third embodiment of the present invention.
Figure 10:
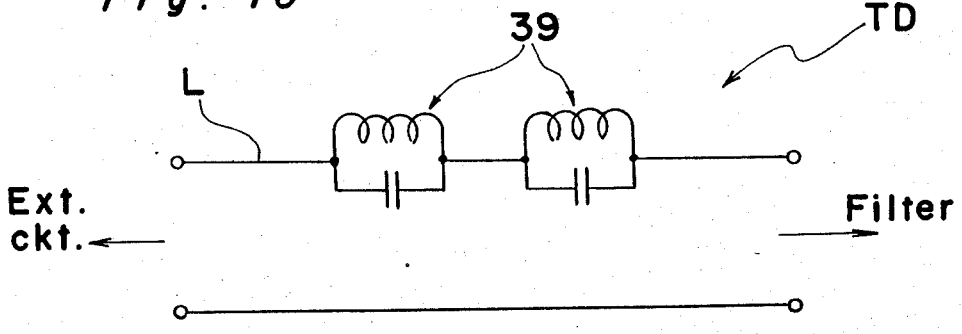
FIG. 10 is an equivalent circuit diagram of the trap construction of FIG. 8.

Referring further to FIGS. 8 through 10, there is shown another electrical trap construction TD according to a third embodiment of the present invention, in which two coaxial resonators similar to resonator 29 in the trap construction TC in FIG. 5 are connected in series with each other. More specifically, in the trap construction TD, the coaxial resonator 29 in the second embodiment of FIG. 5 is replaced by a coaxial resonator 39 including a cylindrical ceramic dielectric member 39*m* having an axial length about twice as long as that of the resonator 29 in FIG. 5, inner and outer conductive electrode layers 39*a* and 39*b* respectively formed on corresponding inner and outer peripheral surfaces of the dielectric member 39*m*, with said outer conductive electrode layer 39*b* being divided, into two portions 39*b*-1 and 39*b*-2, at its central portion in the axial direction by a slit 39*d* extending around its entire circumference, while the inner electrode layer 39*a* and the outer electrode layers 39*b*-1 and 39*b*-2 are respectively connected at opposite ends by short-circuiting electrode layers 39*c* as shown. Since the remaining aspects of the above trap construction TD are generally similar to those of the trap construction TC of FIG. 5, the detailed description thereof is abbreviated here for brevity, with like parts being designated by like reference numerals. It is to be noted here that in the embodiment of FIG. 8, although the inner conductive electrode layer 39*a* of the coaxial resonator 39 is adapted to be in conducting contact with the core pin 14B of the connector 12D, the arrangement may be so modified, for example, that the outer conductive electrode layers 39*b*-1 and 39*b*-2 are in conducting contact with the wall 11*a*, with the inner conductive electrode layer 39*a* being spaced from the core pin 14B.

In the trap construction TD of FIG. 8 as described above, main currents flow as shown by dotted lines in FIG. 9, and an equivalent circuit thereof may be represented as in FIG. 10, in which two parallel resonance circuits provided by the resonator 39 are inserted in series in the hot line L, thereby to trap the spurious signals.

Figure 11:
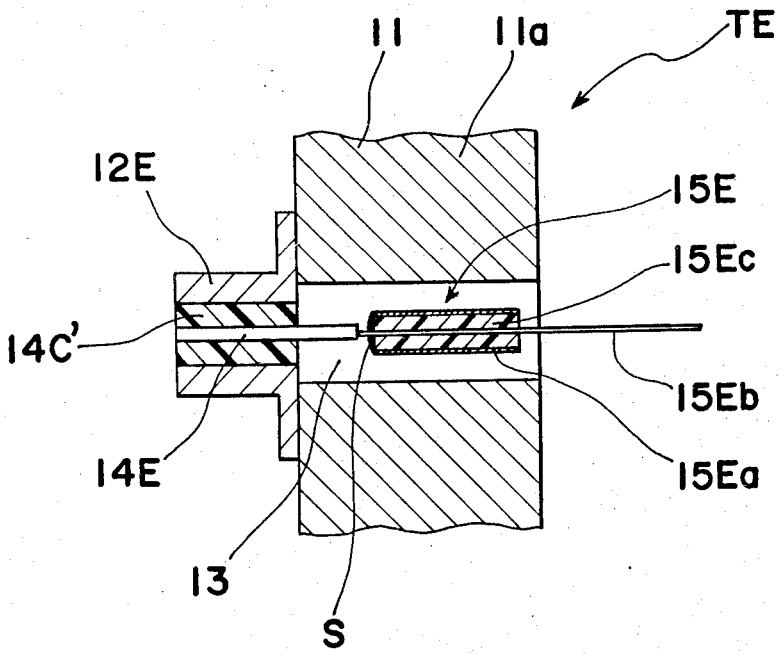
FIG. 11 is a view similar to FIG. 2, showing a modification of the trap construction therein.

Referring finally to FIG. 11, there is shown a modification of the electrical trap construction TA of FIG. 2. In the modified trap construction TE of FIG. 11, the core pin 14E of the input/output connector 12E fixed to the side wall 11*a* of the case 11 extends, to a certain extent, into the through-bore 13 formed in said side wall 11*a* adjacent the connector 12E. A semi-rigid cable 15E including a center or core wire 15E*b*, an outer conductor 15E*a* and an insulating member 15E*c* provided therebetween, is connected, at one end of its core wire 15E*b*, to the core pin 14E of the connector 12E. The outer conductor 15E*a* is spaced from the case 11. The outer conductor 15E*a* and the core wire 15E*b* of the cable 15E are short-circuited at one end, here the end toward the connector 12E, of the outer conductor 15E*a*, for example, by solder S. Thereafter, the outer conductor 15E*a* and the insulating member 15E*c* are cut to such a length as will produce a parallel resonance at the frequency to be trapped. Thus, the embodiment of FIG. 11 constitutes a coaxial resonator having one end of the semi-rigid cable 15E short-circuited and the other end open.

By the trap construction TE in FIG. 11, a trap resonator for spurious signal suppression may be readily obtained having a compact size and at low cost.

It should be noted here that the present invention is not limited in its application to use with a band-pass filter employing dielectric coaxial resonators, but also may readily be applied to band-pass filters for high frequency circuits generally, as well as other trap circuit applications.

As is clear from the foregoing description, according to the present invention, a trap construction may be made compact in size, since a trap resonator for spurious mode suppression, for example, can be accommodated in the connector portion of the high frequency circuit. Moreover, since hardly any disturbance of the reflection characteristics in the pass-band region are caused by insertion of this trap resonator into the line, stable characteristics may be obtained without any adverse effect on the pass-band characteristics.

Furthermore, in trap constructions according to the present invention, where a trap constructed of coaxial cable is accommodated in a through-bore in the wall of the case where the coaxial connector is mounted, a high frequency circuit device employing the trap may similarly be made compact in size, and moreover, by the employment of the coaxial cable, the cost of the trap may be markedly reduced. In addition, in such constructions there is the further advantage that, by adjusting the length of the coaxial cable, the trap frequency may also be readily adjusted.

Although the present invention has been described herein by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. An electrical signal trap device for trapping signals having a selected frequency, comprising:

(a) a connector having a body adapted for attachment to a panel or the like and core pin means mounted within said connector body and insulated therefrom; and (b) cable means including an outer conductor, a core conductor, and a dielectric member provided between said outer conductor and said core conductor, (c) said outer conductor and said core conductor of said cable means being conductively connected to said core pin means of said connector, and (d) a portion of said outer conductor projecting clear of said panel so as to be trimmable for changing said selected frequency.

2. A trap device as in claim 1, wherein such panel is a mounting panel which forms part of a case of a high frequency current device.

3. A trap device as in claim 1, wherein said connector is a coaxial cable connector of the type employed for removable attachment of coaxial cables, and said core pin means is a core pin of said coaxial cable connector.

4. A trap device as in claim 1, wherein said connector is adapted for attachment to a panel adjacent to an aperture therein, with said core pin means being adjacent such aperture and insulated from such panel.

5. A trap device as in claim 4, wherein said cable means is connected to said core pin means so as to extend from said connector into such panel aperture while being insulated from such panel.

6. A trap device as in claim 1, wherein said outer conductor and said dielectric member are of such length that said cable means functions as a quarter-wave resonator for a signal to be trapped.

7. A trap device as in claim 1, wherein said cable means is a selected length of coaxial cable and said core conductor is a core wire of said cable.

8. A trap device as in claim 7, wherein said connector is adapted for attachment to a panel adjacent to an aperture therein, with said core pin means being adjacent such aperture and insulated from such panel; and said cable is connected to said core pin means so as to extend from said connector into such panel aperture while being insulated from such panel.

9. A trap device as in claim 8, wherein said coaxial cable is semi-rigid.

10. A trap device as in claim 8, wherein said cable is insulated from such panel by an air gap.

11. A trap device as in claim 8, wherein said cable is insulated from such panel by an insulative member closely contacting such aperture and said cable.

12. A trap device as in claim 8, wherein the length of said cable is selected such that said cable functions as a quarter-wave resonator for the signal to be trapped.

13. A trap device as in claim 8, wherein said dielectric member within said outer conductor also projects clear of said panel.

14. A trap device as in claim 5, wherein said panel is conductive; and said cable means projects from said aperture and clear of said panel at a portion of said aperture remote from said connector.

15. A trap device as in claim 8, wherein said cable projects from said aperture and clear of said panel at a portion of said aperture remote from said connector.

16. A trap device as in claim 15, wherein said connector is a coaxial cable connector of the type employed for removable attachment of coaxial cables, and said core pin means is a core pin of said coaxial cable connector.

* * * * *